US009283577B2

(12) United States Patent
Sesser et al.

(10) Patent No.: US 9,283,577 B2
(45) Date of Patent: Mar. 15, 2016

(54) SPRINKLER WITH MULTI-FUNCTIONAL, SIDE-LOAD NOZZLE

(71) Applicant: Nelson Irrigation Corporation, Walla Walla, WA (US)

(72) Inventors: George L. Sesser, Walla Walla, WA (US); Barton R. Nelson, Walla Walla, WA (US); Craig B. Nelson, Walla Walla, WA (US); Reid A. Nelson, Walla Walla, WA (US); Richard L. Schisler, Walla Walla, WA (US); Meade M. Neal, Walla Walla, WA (US)

(73) Assignee: NELSON IRRIGATION CORPORATION, Walla Walla, WA (US)

( * ) Notice: Subject to any disclaimer, the term of this patent is extended or adjusted under 35 U.S.C. 154(b) by 197 days.

(21) Appl. No.: 13/927,957

(22) Filed: Jun. 26, 2013

(65) Prior Publication Data

US 2015/0001312 A1 Jan. 1, 2015

(51) Int. Cl.

| | |
|---|---|
| ***B05B 15/02*** | (2006.01) |
| ***B05B 3/02*** | (2006.01) |
| ***B05B 1/32*** | (2006.01) |

(52) U.S. Cl.

CPC . *B05B 3/02* (2013.01); *B05B 1/326* (2013.01); *B05B 15/0283* (2013.01)

(58) Field of Classification Search

CPC ..... B05B 1/3026; B05B 1/326; B05B 3/02
USPC ..... 239/71, 73–74, 443–446, 106, 112, 239/113, 538, 581.1; 137/625.46–625.47; 251/309, 312; 285/401, 376, 913, 27
See application file for complete search history.

(56) References Cited

U.S. PATENT DOCUMENTS

| | | | |
|---|---|---|---|
| 2,060,943 | A | 11/1936 | Lieb |
| 2,281,229 | A | 4/1942 | Bullock |

(Continued)

FOREIGN PATENT DOCUMENTS

| | | |
|---|---|---|
| DE | 58904 | 9/1891 |
| DE | 3719438 A1 | 12/1988 |

(Continued)

OTHER PUBLICATIONS

Partial International Search Report dated Nov. 24, 2014 issued in PCT International Patent Application No. PCT/US2014/054674, 3 pp.

(Continued)

*Primary Examiner* — Len Tran
*Assistant Examiner* — Tuongminh Pham
(74) *Attorney, Agent, or Firm* — Nixon & Vanderhye P.C.

(57) ABSTRACT

A sprinkler and side-loading nozzle insert assembly includes a sprinkler body provided with a flow passage and a nozzle insert seated in a complementary recess in said sprinkler body. The nozzle insert is rotatable to plural operating positions and it includes an elongated, substantially cylindrical insert body having an insert axis about which the nozzle insert rotates. A nozzle bore extends through the insert body on an axis transverse to the insert axis and alignable with the flow passage in one of the plural operating positions. A forward end face is provided with a turning knob and plural index tabs extending radially from the insert body at circumferentially-spaced locations proximate the forward end face. The index tabs are adapted to engage respective index notches in the sprinkler body as the insert body is rotated to the plural operating positions.

11 Claims, 26 Drawing Sheets

(56) References Cited

U.S. PATENT DOCUMENTS

| | | | | |
|---|---|---|---|---|
| 2,918,200 | A | | 12/1959 | Libit et al. |
| 3,563,463 | A | | 2/1971 | Walker |
| 3,769,933 | A | | 11/1973 | Fox |
| 3,982,442 | A | | 9/1976 | Shiurila |
| 4,157,163 | A | | 6/1979 | Pinto et al. |
| 4,801,089 | A | | 1/1989 | Zeman |
| 4,819,872 | A | | 4/1989 | Rosenberg |
| 4,830,281 | A | * | 5/1989 | Calder ..... 239/119 |
| 5,039,016 | A | * | 8/1991 | Gunzel et al. ..... 239/314 |
| 5,211,335 | A | | 5/1993 | Strid |
| 5,234,169 | A | | 8/1993 | McKenzie |
| 5,253,807 | A | | 10/1993 | Newbegin |
| 5,335,859 | A | | 8/1994 | Thayer et al. |
| 5,411,350 | A | | 5/1995 | Breault |
| 5,456,411 | A | | 10/1995 | Scott et al. |
| 5,487,507 | A | | 1/1996 | McDonald et al. |
| 5,560,548 | A | | 10/1996 | Mueller et al. |
| 5,699,962 | A | | 12/1997 | Scott et al. |
| 5,727,739 | A | | 3/1998 | Hamilton |
| 5,749,528 | A | | 5/1998 | Carey et al. |
| 5,762,269 | A | | 6/1998 | Sweet |
| 5,775,744 | A | | 7/1998 | Smith, III |
| 5,820,025 | A | | 10/1998 | Troudt |
| 5,884,847 | A | | 3/1999 | Christopher |
| 5,899,384 | A | | 5/1999 | Solbakke |
| 6,098,490 | A | | 8/2000 | Kowalewski et al. |
| 6,234,411 | B1 | | 5/2001 | Walker et al. |
| 6,244,527 | B1 | | 6/2001 | Ferrazza et al. |
| 6,398,128 | B1 | | 6/2002 | Hamilton et al. |
| 6,405,902 | B2 | | 6/2002 | Everett |
| 6,447,027 | B1 | | 9/2002 | Lilley et al. |
| 6,616,065 | B2 | | 9/2003 | Martin |
| 6,644,877 | B1 | | 11/2003 | Chen |
| 6,669,120 | B2 | | 12/2003 | Vernia |
| 6,676,038 | B2 | | 1/2004 | Gressett, Jr. et al. |
| 6,702,198 | B2 | | 3/2004 | Tam et al. |
| 6,749,134 | B2 | | 6/2004 | Arenson et al. |
| 6,772,964 | B2 | | 8/2004 | Funseth et al. |
| 6,871,795 | B2 | | 3/2005 | Anuskiewicz |
| 6,880,768 | B2 | | 4/2005 | Lau |
| 7,328,853 | B2 | | 2/2008 | Carey et al. |
| 7,431,346 | B2 | | 10/2008 | Frost et al. |
| 7,472,840 | B2 | | 1/2009 | Gregory |
| 7,980,490 | B2 | | 7/2011 | Waddelow et al. |
| 8,910,888 | B2 | | 12/2014 | Sesser et al. |
| 2004/0217196 | A1 | | 11/2004 | Yurek, Jr. et al. |
| 2007/0131792 | A1 | | 6/2007 | Gardner et al. |
| 2007/0158528 | A1 | | 7/2007 | Vella et al. |
| 2009/0200796 | A1 | | 8/2009 | Lai |
| 2009/0321543 | A1 | | 12/2009 | Lawyer et al. |
| 2010/0025983 | A1 | | 2/2010 | Rosch et al. |
| 2010/0102149 | A1 | | 4/2010 | Lawyer et al. |
| 2010/0108783 | A1 | | 5/2010 | Joseph et al. |
| 2012/0269570 | A1 | | 10/2012 | Felber |
| 2012/0312904 | A1 | | 12/2012 | Lawyer et al. |

FOREIGN PATENT DOCUMENTS

| | | | |
|---|---|---|---|
| DE | 4401488 | A1 | 7/1995 |
| EP | 0 255 463 | | 2/1988 |
| FR | 2 266 070 | | 10/1975 |
| GB | 2 125 878 | | 3/1984 |
| GB | 2 164 383 | | 3/1986 |
| JP | 47-1697 | | 8/1972 |
| JP | 5-277406 | | 10/1993 |
| SU | 923635 | | 4/1982 |
| WO | WO 90/15184 | | 12/1990 |
| WO | WO 2007/126201 | | 11/2007 |
| WO | WO 2011/113733 | | 9/2011 |

OTHER PUBLICATIONS

U.S. Appl. No. 13/626,472, filed Sep. 25, 2012 (allowed).

U.S. Appl. No. 14/050,610, filed Oct. 10, 2013 (pending).

U.S. Appl. No. 13/927,992, filed Jun. 26, 2013 (pending).

International Search Report dated Sep. 23, 2014 issued in PCT International Patent Application No. PCT/US2014/044014, 3 pp.

* cited by examiner

SPRINKLER WITH MULTI-FUNCTIONAL, SIDE-LOAD NOZZLE

This invention relates to sprinklers especially suited for, but not limited to agricultural sprinklers used on center-pivot irrigation machines.

BACKGROUND

Center-pivot irrigation machines include large truss spans supported on wheeled towers that rotate about a center support. The truss spans mount many sprinklers along the length of the spans, either directly or suspended from the trusses on rigid or flexible drop hoses.

Because sprinklers of this type (and particularly the sprinkler nozzles) are oftentimes exposed to unfiltered or poorly filtered water containing sand, dirt, debris, etc., it is necessary to periodically clean or flush the individual sprinklers including the sprinkler nozzle bores. At the same time, it is necessary to install nozzles of different orifice size along the truss span length to obtain the desired flow rate in light of the different circle diameters traced by the individual sprinklers as the machine rotates about its center support. Flushing and/or changing nozzle size generally requires at least some disassembly of the sprinkler (and possibly shutting down the machine), which, multiplied over tens or hundreds of sprinklers, is labor intensive, time consuming, and therefore costly.

The present invention seeks to simplify the nozzle changeover and/or flush operations by providing a multi-functional, side-loading nozzle insert that is (1) easily installed and removed, thereby facilitating nozzle changeover; and (2) when installed, rotatable between, for example, "INSERTION", "ON", "OFF", "NOZZLE FLUSH" and "LINE FLUSH" operating positions.

BRIEF SUMMARY OF THE INVENTION

In one exemplary but nonlimiting embodiment, the invention relates to a nozzle insert for side-loading into a complementary recess in a sprinkler body comprising an insert body having an axis of rotation and extending along the axis of rotation from a forward end toward a rearward end, a nozzle bore extending through the insert body on an axis intersecting the axis of rotation; a flush groove formed on an outer surface of the insert body and configured to direct water toward the rearward end; a forward end face provided with a turning knob; plural index tabs proximate the forward end face and extending radially from the insert body at circumferentially-spaced locations, adapted to engage respective detents in the sprinkler body.

In another version, the invention relates to a sprinkler and side-loading nozzle insert assembly comprising a sprinkler body provided with a flow passage and a nozzle insert seated in a complementary recess in the sprinkler body, the nozzle insert rotatable to plural operating positions; the nozzle insert comprising an elongated insert body having an insert axis about which the nozzle insert rotates, a nozzle bore extending through the insert body on an axis intersecting the insert axis and alignable with the flow passage in one of the plural operating positions, a forward end face provided with a turning knob, plural index tabs extending radially from the insert body at circumferentially-spaced locations proximate the forward end face, adapted to engage respective index notches in the sprinkler body as the insert body is rotated to the plural operating portions.

In still another version, the invention relates to a sprinkler comprising sprinkler body having a fluid passage extending along a first axis; a recess in the sprinkler body extending along a second axis intersecting the first axis; a forward end of the recess defined by a ring formed with plural insert slots and plural index detents offset from the plural insertion slots; a rotatable nozzle insert comprising a substantially cylindrical insert body having a rotation axis coincident with the second axis, and a nozzle bore extending through the insert body on an axis coincident with the first axis; a forward end face provided with a turning knob; plural index tabs located behind the forward end face, extending radially from the insert body and receivable within the insertion slots; the nozzle insert, upon passing through the insert slots, rotatable between plural index positions defined by the plural index notches, such that the plural index tabs engage respective ones of the plural index notches at each of the plural index positions, wherein at one of the plural index positions, the nozzle bore is aligned with the fluid passage in an ON position, and in another of the plural index positions, the nozzle bore is reverse-aligned with the fluid passage in a NOZZLE FLUSH position.

In still another version, the invention relates to a sprinkler assembly comprising a sprinkler body, a flow passage within the sprinkler body and defining a center axis, an elongated recess extending into the sprinkler body from one side of the sprinkler body, intersecting the center axis and the flow passage, and a support structure for mounting a water distribution plate aligned with and downstream of the elongated recess; a nozzle insert received within the elongated recess, the nozzle insert provided with a nozzle bore including a nozzle outlet orifice, a shut-off surface for shutting off flow through the flow passage, and a flush groove formed on a surface circumferentially spaced from the nozzle bore, wherein the nozzle insert is indexable via rotation to at least a first operating position where the nozzle bore and the nozzle orifice are aligned with the flow passage; a second operating position where the shut-off surface seals against the flow passage to prevent flow through the nozzle bore; a third operating position where the nozzle bore is reversed such that the nozzle outlet orifice is aligned with and adjacent the flow passage to thereby permit flushing of the nozzle bore; and a fourth position where the flush groove is aligned with the flow passage such that a stream exiting the flow passage is directed into the flush groove to thereby flush the flow passage upstream of the nozzle insert.

The invention will now be described in greater detail in connection with the drawings identified below.

DETAILED DESCRIPTION OF THE DRAWINGS

Figure 1:
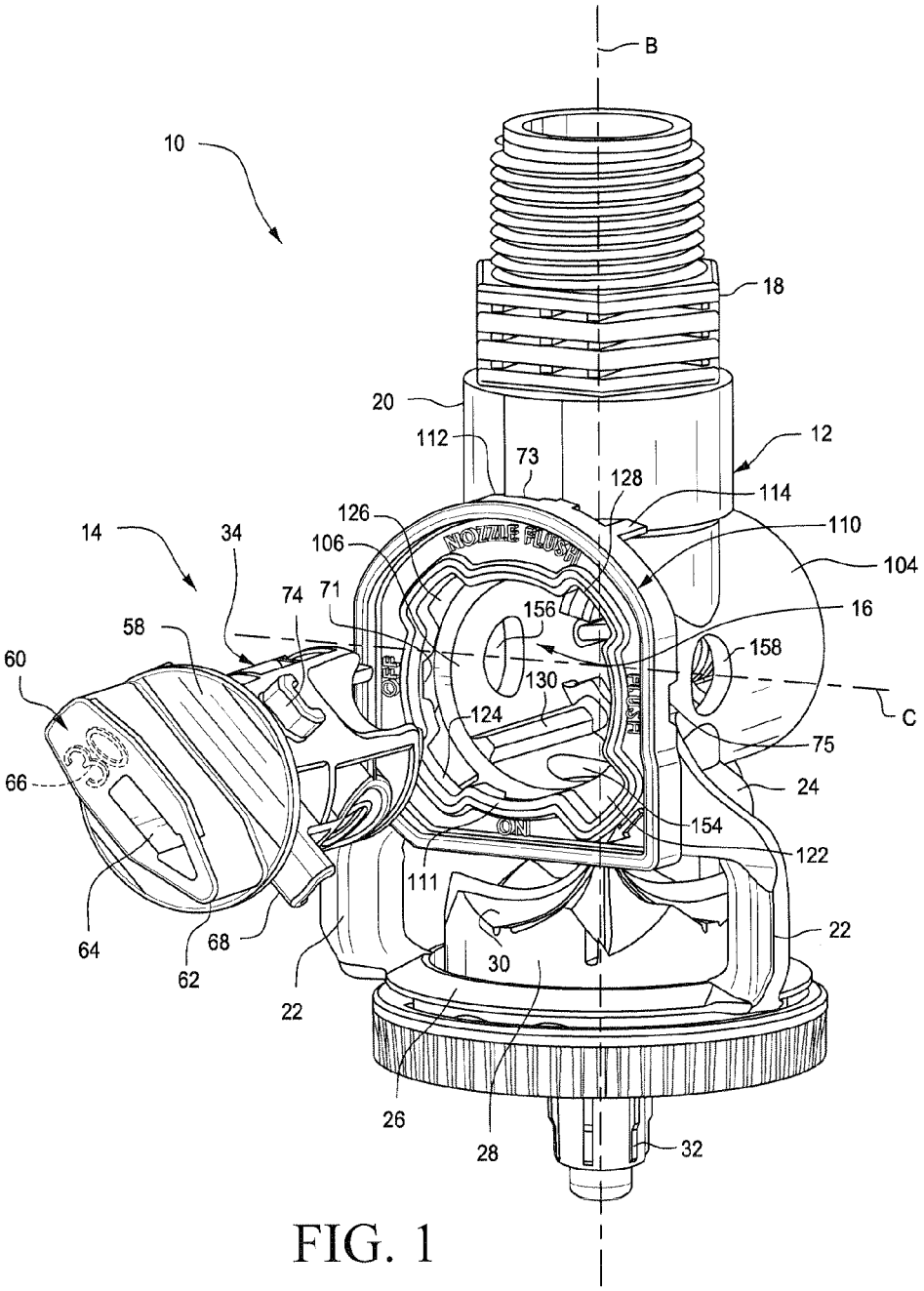
FIG. 1 is a perspective view of a sprinkler body and nozzle insert in accordance with a first exemplary but nonlimiting embodiment, with the nozzle insert removed from the sprinkler body.

FIG. 1 illustrates a sprinkler assembly 10 that includes a sprinkler body 12 and a nozzle insert 14 receivable within a sideways-oriented, complementary recess 16 provided in the sprinkler body 12. The sprinkler body mounts a conventional adapter 18 via a threaded coupling at the upstream end 20 of the sprinkler body 12. A plurality of support struts 22 are provided at the downstream end 24 of the sprinkler body, the support struts connected to a mounting ring 26 adapted for securing a conventional water deflector or distribution plate 28 formed with grooves 30 that typically cause the plate to rotate when impinged upon by a stream emitted from the sprinkler nozzle. The plate 28 may incorporate an otherwise conventional viscous brake or rotational speed retarding device 32.

Before describing the nozzle insert 14 and sprinkler body 12 in detail, it is important to note that any reference to relative terms such as "upper", "lower", "left-side", "right-side", "front" and "rear" relate to the sprinkler body and nozzle insert as oriented in the various figures and are not intended to be in any way limiting because the sprinkler may assume other orientations in use. Since, however, the sprinkler will generally assume the orientation shown in FIG. 1 or a reverse (inverted) orientation, it is appropriate to refer to the nozzle insert 14 as a "side-loading" nozzle insert.

Figure 2:
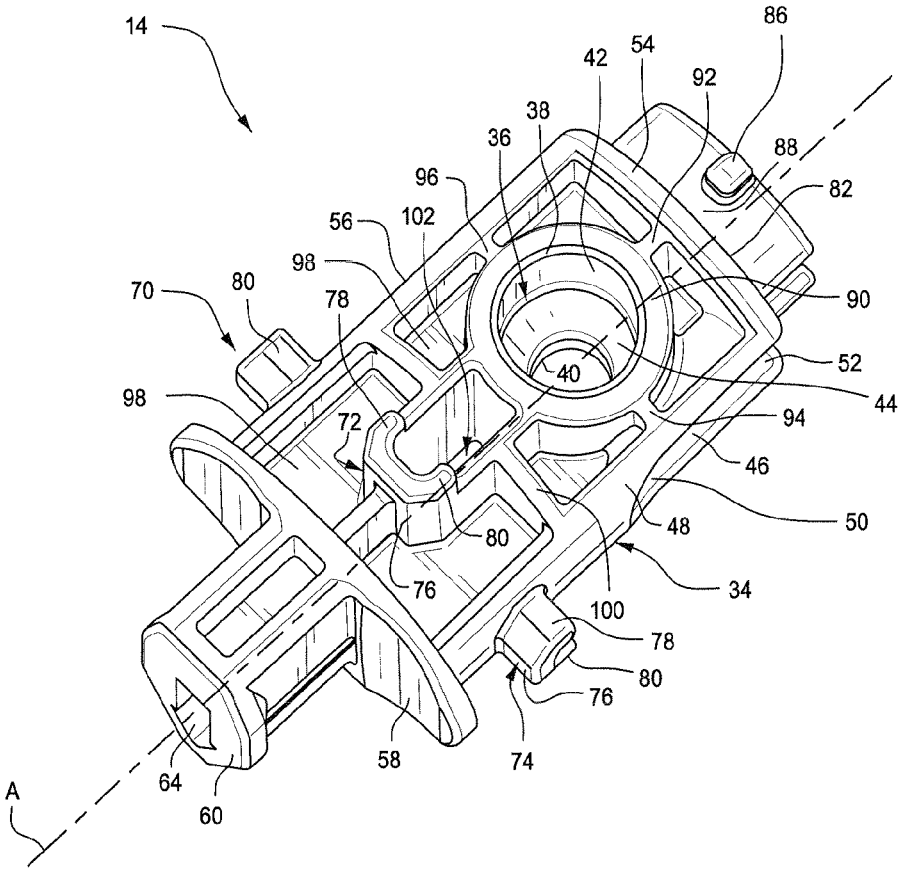
FIG. 2 is a top, right front perspective view of the nozzle insert shown in FIG. 1.
Figure 3:
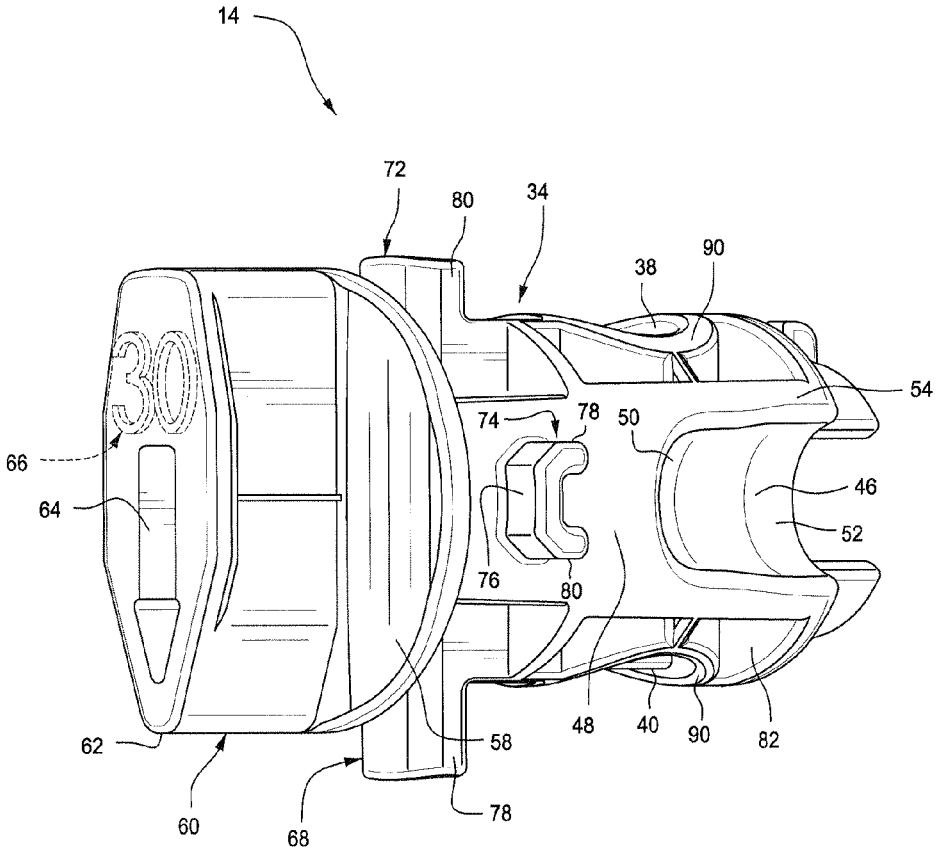
FIG. 3 is a right side, front perspective view of the nozzle insert shown in FIG. 2.
Figure 4:
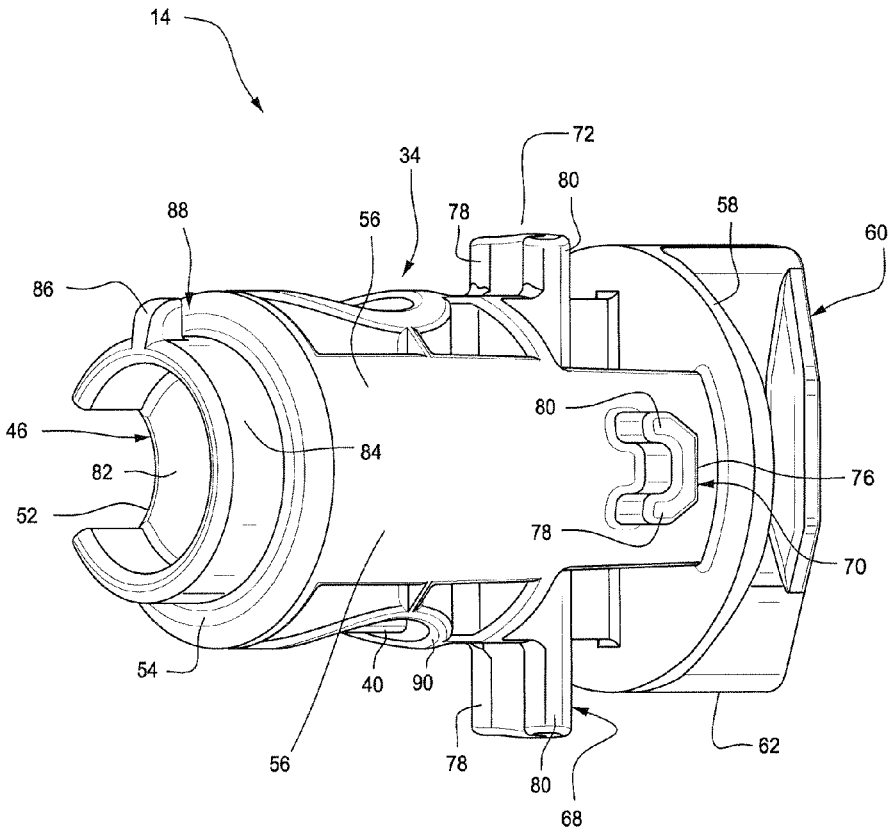
FIG. 4 is a left side, rear perspective view of the nozzle insert shown in FIGS. 2 and 3.

With continued reference to FIG. 1, but also especially to FIGS. 2-4, the nozzle insert 14 is formed as a substantially-cylindrical body (referred to herein as the "insert body") 34, preferably injection-molded of hard plastic material such as PVC (or other suitable plastic or metal material). The insert body 34 has a longitudinal center axis or axis of rotation A (FIG. 2), also referred to herein as the "insert axis" that when installed in the sprinkler body, is perpendicular to a longitudinal center axis B (FIG. 1) of the sprinkler body, also referred to herein as the "sprinkler axis". The insert body need not intersect in a perpendicular fashion in some versions of the invention, and instead may be offset angularly or laterally, for example, so long as it is positioned to intersect the water flow path.

Figure 11:
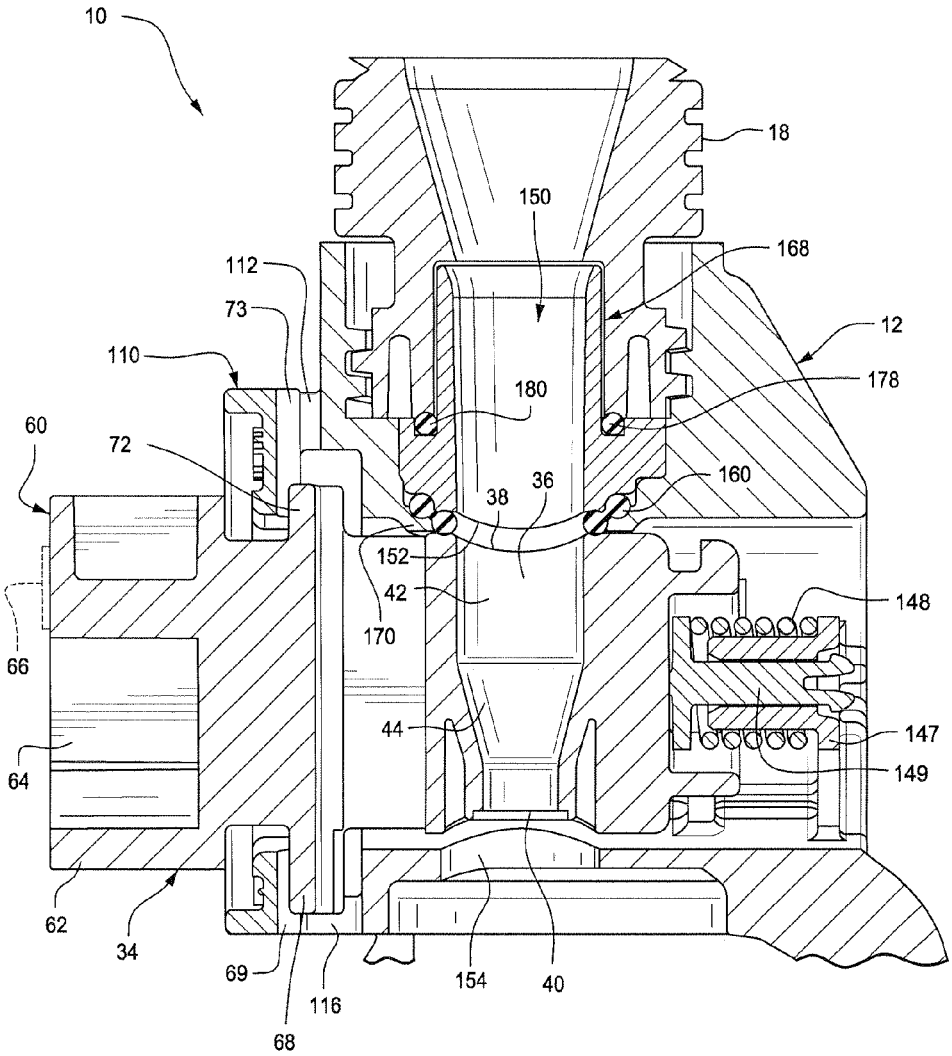
FIG. 11 is a vertical cross section of the sprinkler body and nozzle insert as shown in FIG. 10.

The insert body 34 is formed with a nozzle bore which, in the illustrated version, extends transversely of the insert axis A from an inlet end 38 to an outlet end or nozzle orifice 40. As best seen in FIGS. 2 and 11, the nozzle bore 36 is comprised of a straight, relatively larger-diameter portion 42 extending from the inlet end 38, and an inwardly-tapered portion 44 extending from a location about midway between the inlet end and outlet end to the smaller-diameter nozzle orifice 40.

A "flush" groove 46 (FIG. 3) is formed in a first solid peripheral portion 48 of the insert body, circumferentially between the nozzle inlet 38 and nozzle orifice 40, and extending parallel to the insert axis A and perpendicular to the nozzle bore 36. The flush groove 46 has an inlet end 50 and extends substantially axially to an open outlet end 52 at the rearward end 54 of the insert body 34 as best seen in FIGS. 3 and 4. The flush groove 46 communicates with a sprinkler body flow passage when the nozzle insert is rotated to the LINE FLUSH position as described further herein.

A second solid peripheral portion 56 (FIG. 4) of the insert body 34, diametrically opposite the first solid peripheral portion 48, provides a shut-off surface when the nozzle insert 14 is rotated to the "OFF" position as also described further herein.

The nozzle insert 14 is also formed with a forward, disk-like end face 58 (FIGS. 1-3) that, in the exemplary embodiment, is round in shape, with a diameter larger than the diameter of the remainder of the insert body 34. The forward end face 58 is formed or provided with a relatively narrow but easily grasped turning knob 60 which extends centrally across the end face 58 and through the insert axis A. As shown, the turning knob 60 is tapered to a rounded point 62 at one end, and thus also serves as a pointer device that indicates the rotational position of the nozzle insert 14 as indicated by position indicia e.g., ON, OFF, NOZZLE FLUSH and FLUSH (FIG. 1) on the sprinkler body 12 at locations corresponding to the four operating positions of the nozzle insert. To reinforce this positional aspect of the turning knob 60, an arrow-like indicator 64 may be formed within or on the knob, oriented to match or align with the pointing direction of the knob. Because the indicator 64 is formed as a slot in the illustrated embodiment, it will accept a standard flat-blade screwdriver for situations where extra turning torque may be required due to impacted sand, etc. A nozzle orifice size reference number 66 (see, for example, FIGS. 1, 3, 5 and 6) may also be provided on the knob 60, for example, above the arrow-like indicator 64, providing the user with a clear indication of the nozzle orifice size. It will be appreciated that the nozzle orifice size number could be placed in any readily visible location on the nozzle insert 14, but preferably on the outwardly facing surface of the forward end face 58 or on the knob 60 itself (as shown). The nozzle inserts may also be color-coded by orifice size. In addition, the arrow-like indicator 64 as well as the nozzle orifice number 66 could be provided in the form of separately-applied adhesive labels or the like.

It will also be appreciated the forward end face 58 and collar 110 is will serve to shield the user from water spray that may be directed toward the user when the nozzle insert is rotated between its operating positions, or when the nozzle insert is in the NOZZLE FLUSH or LINE FLUSH positions.

It will also be appreciated that other reference markings or indicia may be applied to the forward end face of the nozzle insert. For example, a sprinkler number corresponding to a sprinkler installation location along a truss span could be applied on one side of the turning knob 60 to assist in installing sprinklers with correct nozzle sizes in the desired sequence along a center-pivot truss span or the like. In this regard, sprinklers as described herein may be delivered to the customer slidably mounted on a string or wire in a suggested installation sequence as verified by the location numbers on the sprinklers.

Behind and adjacent the forward end face 58 of the insert body 34, there are four index tabs 68, 70, 72 and 74 (FIGS. 2-4) extending radially outwardly at 90-degree intervals about the insert body 34. Each index tab has a rounded U-shape when viewed in plan, including a front face 76, and a pair of spaced, substantially-parallel and rearwardly-extending stems 78, 80, best seen in FIG. 2. The stems 78, 80 are beveled where they join with the front face 76 to facilitate rotation of the nozzle insert, as explained further below. For convenience, the reference numbers 76, 78 and 80 are used with each of the index tabs 68, 70, 72 and 74 since the tab shapes are substantially identical (except as noted below), but the separate numbers for the four index tabs themselves facilitate the description of the rotation of the nozzle insert 14 from an "INSERTION" position through the four additional indexed operating positions. Note that all the index tabs have similar width and radial length dimensions as well as similar cross-sectional shapes, with the exception of index tab 68 which has a greater radial length dimension than remaining index tabs 70, 72 and 74.

The rearward end 54 of the insert body 34 has a rearward end face 82 and a rearwardly-projecting part-annular ring 84 of smaller diameter than the rearward end face 82. A keeper tab 86 projects radially away from a rearward edge of the part-annular ring 84, leaving an axial gap 88 between the keeper tab 86 and the rearward end face 82. Note that the keeper tab 86 is axially aligned with the index tab 72 at the forward end of the insert body.

Between the forward end face 58 and the rearward end face 82 are variously configured surfaces/ribs that facilitate molding, that serve to strengthen the insert body and/or that provide bearing surfaces when the nozzle insert 14 is installed and rotated within the sprinkler body 12. For example, on the nozzle bore inlet side of the insert body 34, it can be seen that the bore wall 90 at the inlet end 38 (FIGS. 2-4) is strengthened by radially-extending ribs 92, 94, 96 that extend along substantially the entire length of the nozzle bore, on either side of a center web (FIG. 2) extending between the forward and rearward end faces 58, 82, respectively, and between the diametrically-opposed solid peripheral portions 48, 56.

The stems 78, 80 of the index tabs 68 and 72 extend, at a reduced radial height, to an internal, disk-like wall 100, the outer edge of which provides a bearing surface for the insert 14 when installed within the sprinkler body. The wall 100 has a similar diameter to the end face 82, and that diameter is carried through the solid portions 48, 56. A through-opening 102 formed between the nozzle bore wall 90 and the index tabs 68, 72 thus providing space for a string, wire or the like, upon which several similar nozzle inserts may be slidably mounted or "strung", in the desired installation sequence as described above, as a matter of convenience to the customer/purchaser.

It will be understood that the location and configuration of the various reinforcement ribs are determined at least in part by manufacturing considerations, especially if the insert is of molded plastic construction and, as such, are not intended to limit the scope of the invention.

Returning to FIG. 1, the sprinkler body recess is defined by a substantially-cylindrical wall 104 concentric with the insert axis A (see FIG. 2). The recess 16 is open at a forward end 106 as viewed in FIG. 1 and partially closed at a rearward end 108 as seen, for example, in FIG. 7. A collar 110 is spaced from the forward end 106, supported by a pair of upper ribs 112, 114 (FIGS. 1, 5, 8, 10, 11, 16) and a pair of lower ribs 116, 118 (FIGS. 10, 11, 13, 16), thereby leaving an axial gap 120 between the forward end 106 and the collar 110.

The collar 110 is formed with a generally-circular opening defined by wall 111 concentric with the cylindrical wall 104, interrupted by four insert slots 122, 124, 126 and 128 that are spaced and oriented to mate with and receive the four index tabs 68, 70, 72 and 74, respectively, on the insert body 34. Note that the radial length of insert slot 122 is extended to accept the longer index tab 68. With this arrangement, insertion of the insert body 34 into the sprinkler body recess 16 can only be achieved in one orientation of the insert body, i.e., with index tab 68 aligned with insert slot 122. This orientation of the nozzle insert 14 relative to the sprinkler body 12 is referred to herein as the "INSERTION" position (but note there are no corresponding indicia on the collar 110 in the illustrated version). Below the slot 122, however, is an arrow indicating a direction of rotation upon installation of the nozzle insert and is thus also intended to show an initial location of the nozzle insert. Upon insertion, the gap 120 between the collar 110 and the forward end 106 of the sprinkler body 12 permits the index tabs 68, 70, 72 and 74 to rotate about the insert axis A behind the collar 110 as described further herein. The back side of the collar 110 is provided with four, radially-oriented index notches 69, 71, 73 and 75 located symmetrically between the respective slots 122, 124, 126 and 128, and in locations corresponding to the "ON", "OFF", "NOZZLE FLUSH" and "FLUSH" operating positions of the nozzle insert 14.

As will be explained below, the index tabs 68, 70, 72 and 74 are received sequentially in the respective index notches 69, 71, 73 and 75 as the nozzle insert 14 is rotated to each of its four operating positions.

Within the recess 16, there is a pair of substantially-parallel elongated ribs 130 extending internally along the wall 104, parallel to the insertion axis A, on either side of a sprinkler body aperture 154 and concentric with the sprinkler axis B. These ribs are axially aligned with the insert slots 122 and 124 (only one rib is visible, in FIG. 1) and engage the edge of bore wall 90 on the nozzle orifice side of the bore 36, and surface 56 on the insert body 34 during insertion, and engage other surfaces, e.g., surface 48 and bore wall 90 on the inlet side of the nozzle bore 36, during subsequent rotation of the nozzle insert 14. As will be appreciated, ribs 130 help center the nozzle insert 14 within the recess 16 (including aligning the nozzle bore relative to the flow passage 150 (FIG. 11) in the sprinkler body) while also minimizing surface friction during rotation of the nozzle insert.

Proximate the rearward end of the recess 16, there are three, circumferentially-spaced cam tabs 136, 138, 140 and a stop tab 142 (see FIG. 22), three of which (136, 138 and 140) are substantially axially aligned with insert slots 124, 122 and 128, respectively. The fourth tab, stop tab 142, is offset slightly from the insert slot 126 in a counterclockwise direction (as viewed from FIG. 6, for example) for reasons explained below. These three cam tabs and one stop tab interact with the keeper tab 86 on the insert body 34 during rotation of the nozzle insert 14 as also described further below.

As noted above, the rearward end 104 of the sprinkler body recess 16 is partially closed. Specifically, a pair of arcuate segment walls 144, 146 (FIG. 14) join at a support hub 147 on the insert axis A for receiving a spring 148 (FIG. 11) also coaxially aligned with the insert axis A, and which exerts a force on the insert body 34 in a direction opposite the insertion direction. In this embodiment, spring 148 is held on the hub 147 by a "force applicator" 149 snap-fit into the base of the hub. It will be appreciated that the force applicator 149 could be omitted in other versions of the invention. In fact, various spring-mounting/retaining arrangements as well as other spring types may be employed and remain within the scope of the invention.

The sprinkler body 12 is also provided with a flow passage 150 (FIG. 11) which includes a first aperture 152 downstream of the adapter 18 that communicates with the inlet end 38 of the nozzle bore 36. A second aperture 154 located downstream of the nozzle orifice 40 is also coaxial with the sprinkler body axis B. The aperture 154 is spaced from the interior of wall 104 and nozzle orifice 40, and has a diameter larger than the orifice 40, thus providing ample space for the stream emitted from the nozzle. The aperture 152 locates and retains a flexible seal 160 (described below) designed to engage and seal the inlet side of the nozzle bore 36.

In addition, the sprinkler body 16 is provided with a pair of apertures 156, 158 (FIG. 1) formed in wall 104 along a third axis C that intersects and is perpendicular to the axes A and B. These apertures, which are preferably but not necessarily diametrically opposed) facilitate manual cleaning of the nozzle bore 36 when the nozzle insert 14 is rotated to the OFF position and to the LINE FLUSH position as described below.

Figure 23:
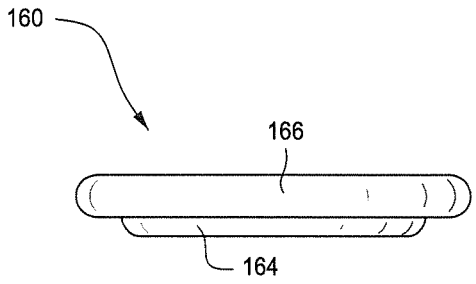
FIG. 23 is a side elevation of a seal employed between the sprinkler body and nozzle insert in the first exemplary embodiment.
Figure 24:
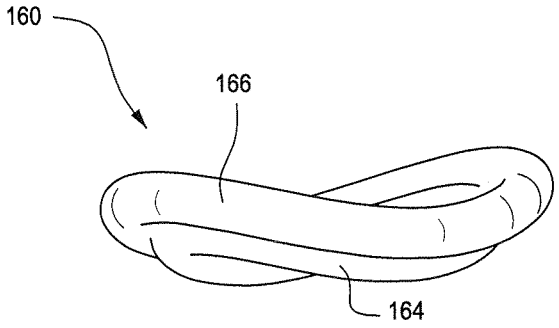
FIG. 24 is a perspective view of the seal shown in FIG. 23, but illustrating a shape of the seal when installed.

FIGS. 23 and 24 illustrate the seal 160 in isolation. FIG. 23 shows a side elevation of the seal 160 in a normal uninstalled state where it assumes a substantially planar orientation. FIG. 24 illustrates the shape assumed by the flexible seal when installed, conforming to the round shape of both the wall 104 and the insert body 34. The seal 160 may be characterized as a "double o-ring" seal formed by joined inner and outer ring portions 164, 166, a configuration that enables secure mounting about the outer ring 166, as well as flexing of the inner ring 164 to conform to the sealed surface, i.e., the nozzle insert surface surrounding the nozzle bore 36 at the inlet end 38. In addition, the "double o-ring" configuration is particularly advantageous in that, as the nozzle insert body 34 rotates across the seal, the inner ring 164 conforms to the surface of the nozzle insert body, while the rounded shape of the inner ring reduces the likelihood of excessive friction that might otherwise lead to tears or other undesirable surface abrasion. At the same time, the relatively soft, flexible material provides an effective seal with only a light compression force. Traditional ball and plug valves use hard seals with high compression loads required to effect the seal, resulting in a further need for a relatively large and otherwise undesirable handle to overcome the friction.

Figure 25:
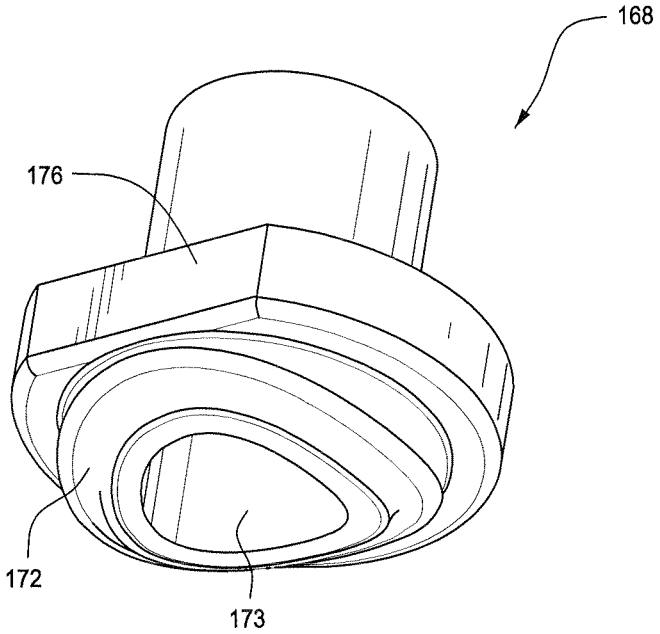
FIG. 25 is a perspective view of a sprinkler body seal retainer sleeve employed in the sprinkler body as shown in FIGS. 1-22.
Figure 26:
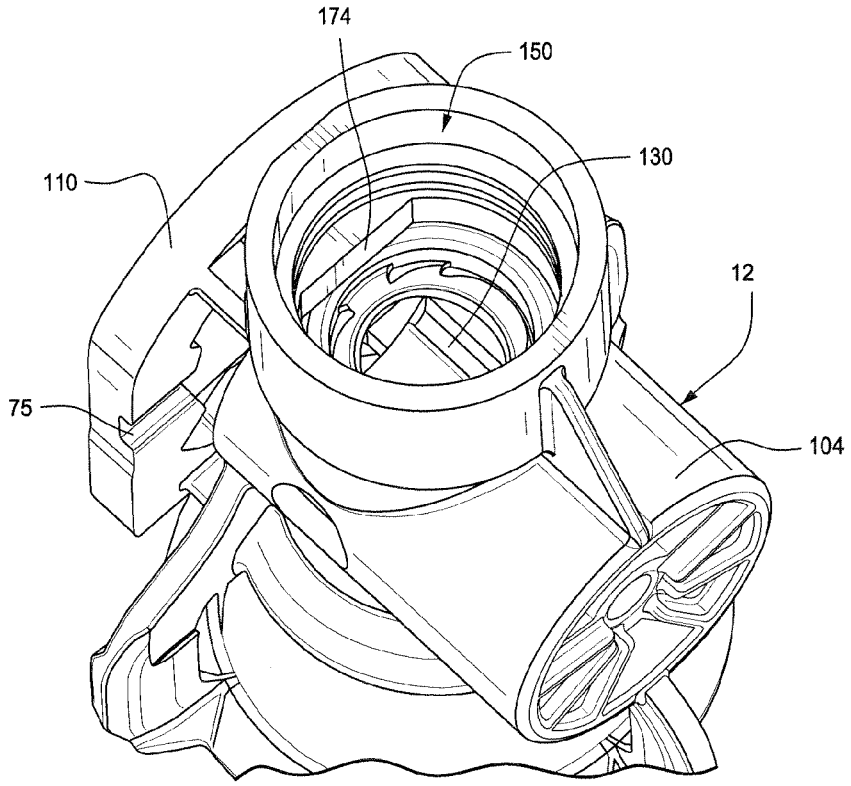
FIG. 26 is a top perspective view of the sprinkler body with the nozzle insert and seal retainer sleeve removed.

FIG. 25 shows the seal retainer sleeve 168 removed from the flow passage 150 in the sprinkler body. The seal retainer sleeve 168 supports the seal 160 about its outer peripheral edge 166 (see FIGS. 11, 17, 19 and 21), and effectively clamps the seal 160 between the retainer sleeve and a radial flange 170 surrounding the aperture 152. Note that the lower end or rim 172 of the seal retainer sleeve surrounding the bore 173 that forms part of the flow passage 150 is also shaped to conform to the inlet end 38 of the nozzle bore 36. As noted above, this arrangement allows the inner portion 164 of the seal to flex as needed to conform to the curvature of the insert body 34 and thereby effectively prevent any leakage where the flow passage communicates with the nozzle bore. FIG. 26 shows the interior of the flow passage 150, including a flat 174 that mates with a corresponding flat 176 on the seal retainer sleeve 168, facilitating proper alignment of the sleeve within the flow passage. Note that the seal retainer sleeve 168 is held in place by the adapter 18 and an additional annular seal 178 (e.g., an o-ring seal) may be inserted in a groove 180 at the lower or downstream edge of the retainer sleeve thereby also preventing leakage at the sleeve/adapter interface.

Operation

Figure 5:
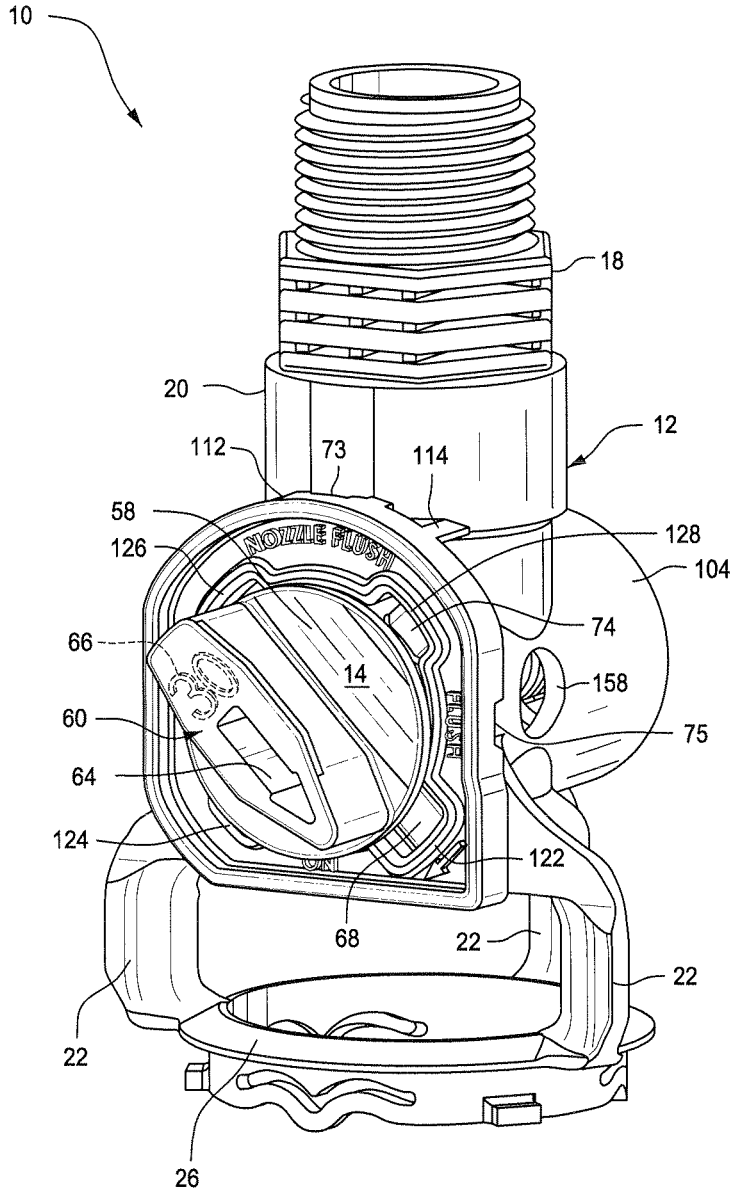
FIG. 5 is a perspective view similar to FIG. 1 but with the nozzle insert installed within the sprinkler body, in an installation or "INSERTION" position.
Figure 6:
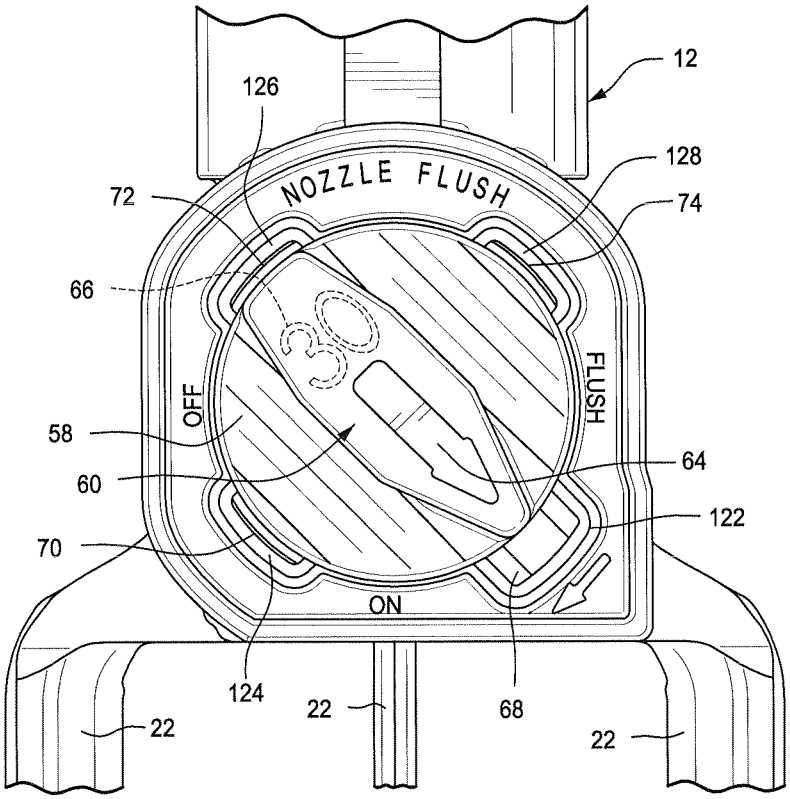
FIG. 6 is an enlarged, partial front view of the sprinkler body and nozzle insert shown in FIG. 5.
Figure 7:
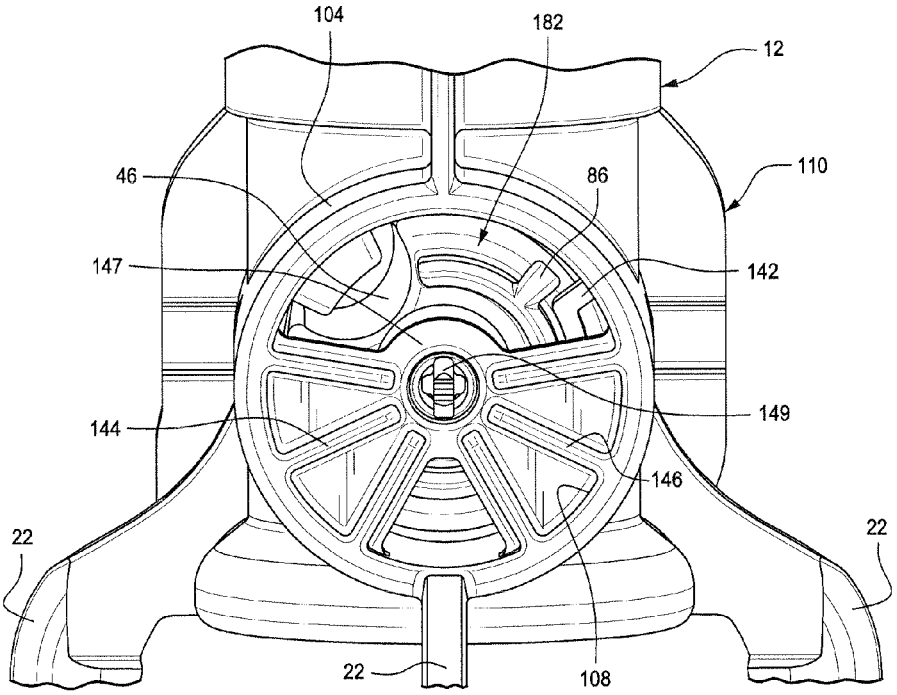
FIG. 7 is an enlarged, partial rear view of the sprinkler body and nozzle insert shown in FIG. 5.
Figure 8:
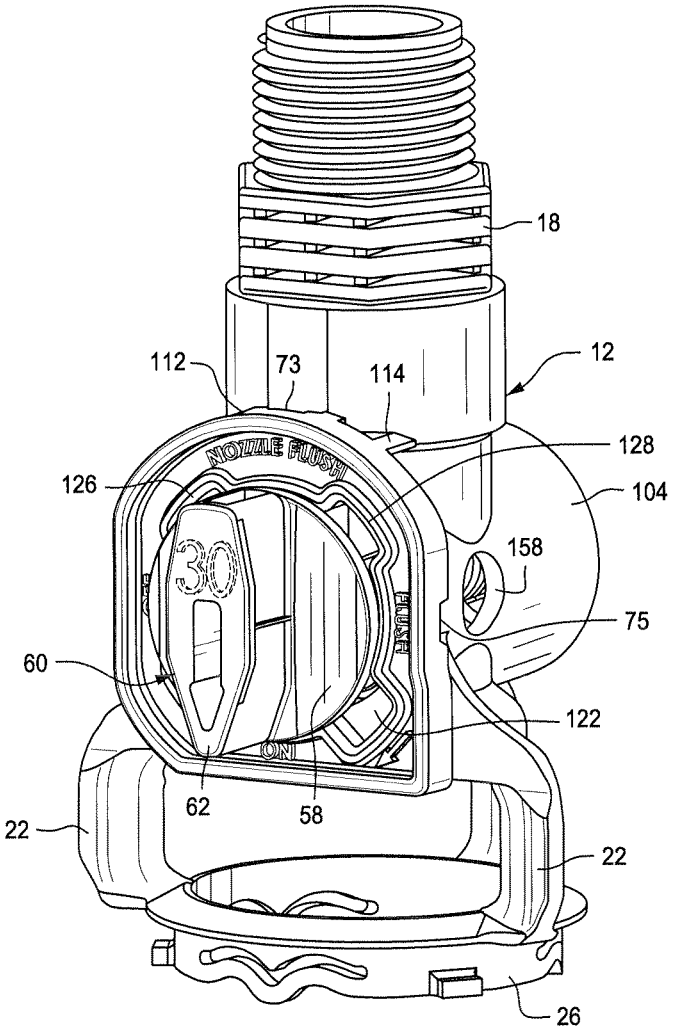
FIG. 8 is a perspective view similar to FIG. 5 but with the nozzle insert rotated in a clockwise direction from the installation position to the "ON" position.
Figure 9:
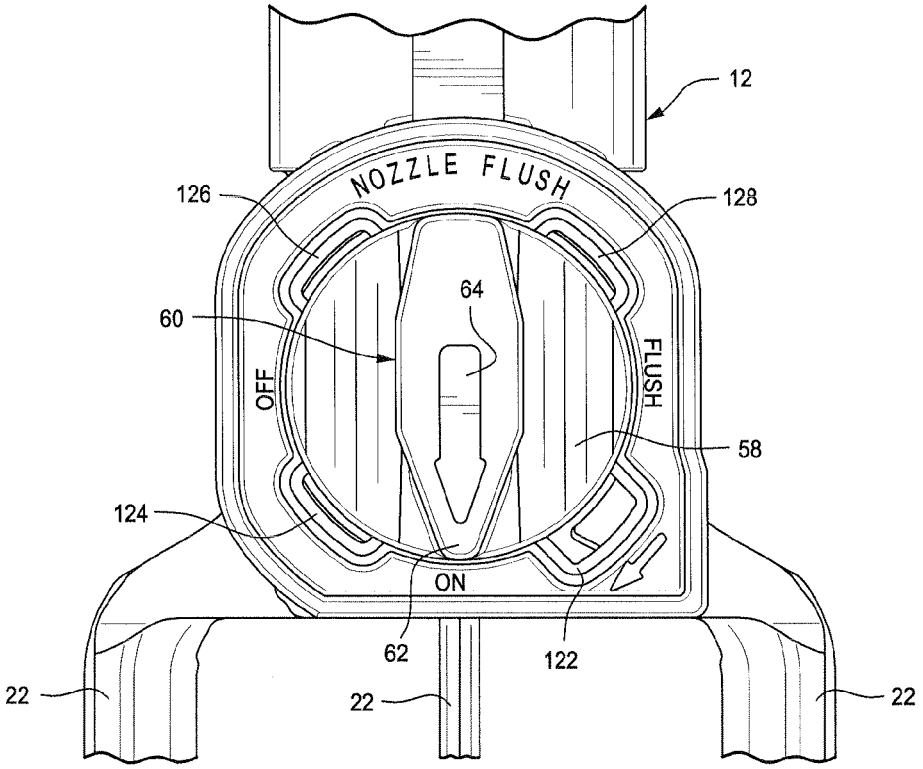
FIG. 9 is an enlarged partial front view of the sprinkler body and nozzle insert as shown in FIG. 8.
Figure 10:
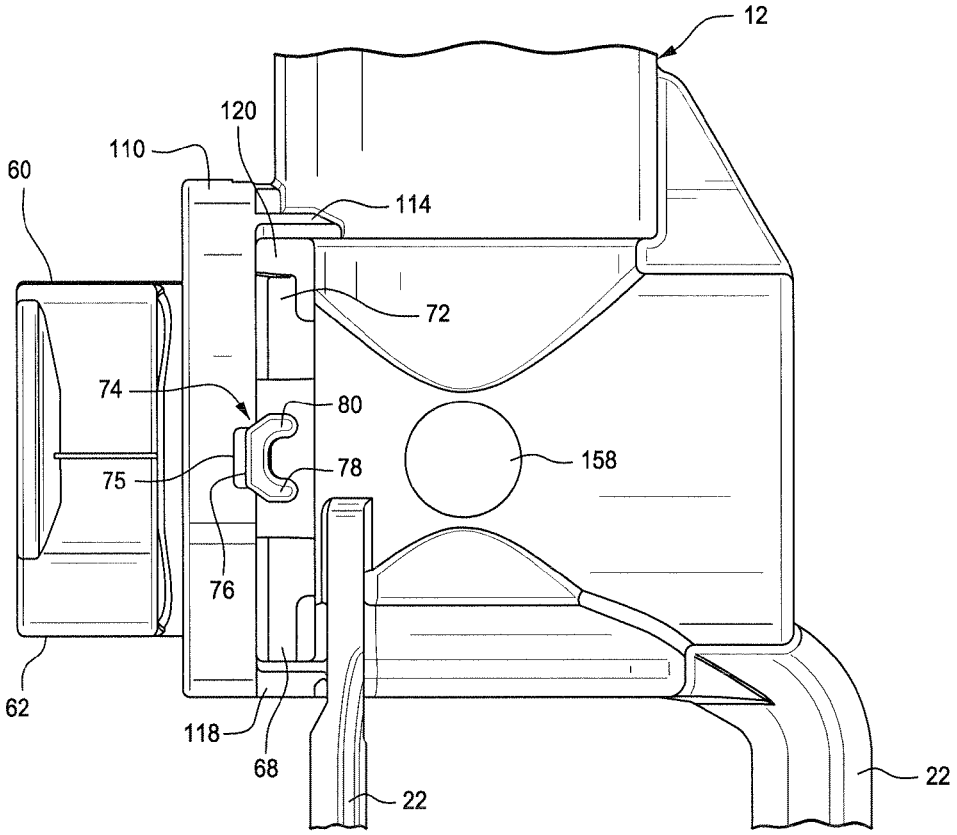
FIG. 10 is an enlarged, partial right side elevation view of the sprinkler body and nozzle insert as shown in FIG. 8.

Reference is initially made to FIG. 1 which illustrates the nozzle insert 14 removed from the sprinkler body 12, but oriented in the INSERTION position. In this position or orientation, index tab 68 is aligned with the insert slot 122. It can be seen that the extended radial length of the index tab 68 matches the extended radial length of the insert slot 122 in the collar 110, thus permitting full insertion of the nozzle insert 14 into the complementary recess 16 of the sprinkler body 12. FIGS. 5, 6 and 7 show the nozzle insert 14 fully inserted into the sprinkler body 12. Here, the index tab 68 has passed through the insert slot 122; the index tab 70 has passed through the insert slot 124; the index tab 72 has passed through the insert slot 126; and the index tab 74 has passed through the insert slot 128. When fully inserted, the keeper tab 86 lies adjacent and engaged with the stop tab 142 (FIG. 7) thereby preventing rotation of the nozzle insert 14 in a counterclockwise direction from the INSERTION position, as viewed in FIGS. 1, 5 and 6.

The coil spring 148 exerts a force on the nozzle insert 14 in a direction opposite the insertion direction so that, unless the nozzle insert is turned from the position shown in FIGS. 5 and 6 in a clockwise direction, the spring 148 will tend to push the nozzle insert 14 out of the sprinkler body recess 16.

FIGS. 8-11 show the nozzle insert 14 rotated 45 degrees in the clockwise direction to the "ON" position. The nozzle bore 36 is axially aligned with flow passage 150 and its inlet and outlet apertures 152, 154, with leakage around the inlet aperture 152 and the nozzle bore inlet 38 prevented by the seal 160 (FIG. 11). At the outlet end (i.e., at the nozzle orifice 40), no seal is necessary because the nozzle orifice 40 has a diameter smaller than the outlet aperture 154, thus allowing the stream to pass cleanly through the aperture 154. In addition, note that the spring 148 continues to exert a force in direction opposite the insertion direction and thus, when the nozzle insert 14 is rotated to the "ON" position, the index tabs 68, 70, 72 and 74 are resiliently biased into corresponding index notches 69, 71, 73 and 75 on the rear or back side of the collar 110. Note that the dimensions of the index tabs and index notches are such that the beveled edges engage the notch edges, preventing full seating of the index tabs within the index notches, and facilitating rotation out of the operating position even with the spring 148 urging the tabs toward the notches (see FIGS. 10 and 11). This configuration results in the desired stop action at each operating position while also facilitating rotation out of the respective index notches with the desired tactile sensation.

Figure 12:
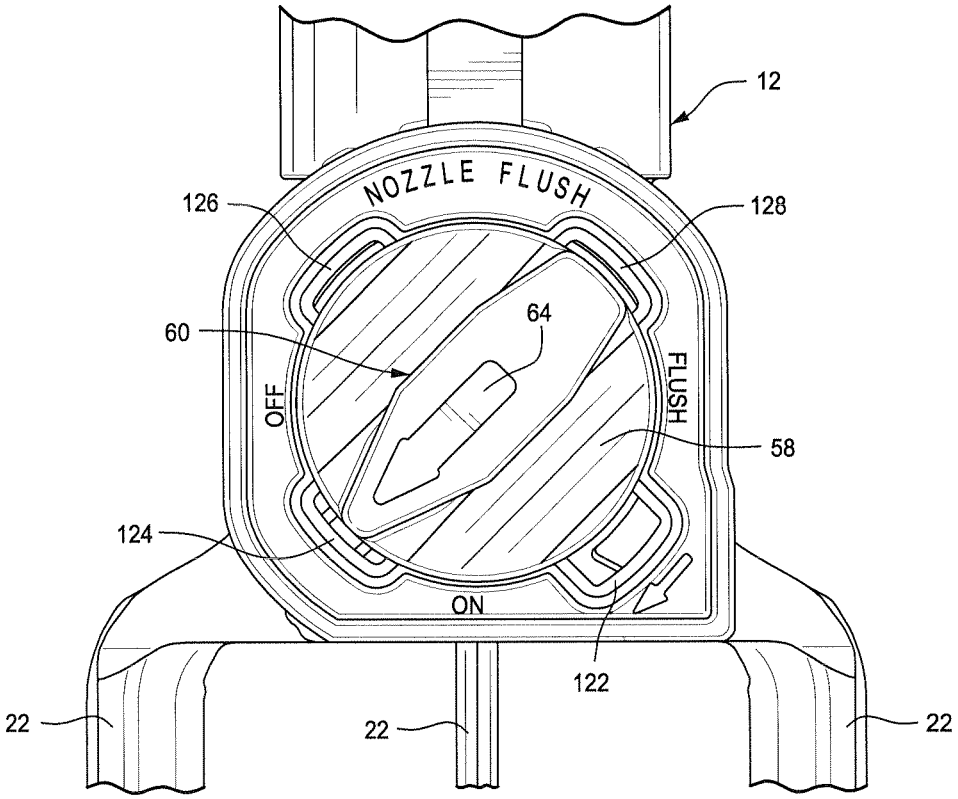
FIG. 12 is an enlarged partial front view of the sprinkler body and nozzle insert, with the nozzle insert rotated 45 degrees in a clockwise direction from the "ON" position to an intermediate position between the "ON" position and the "OFF" position.
Figure 13:
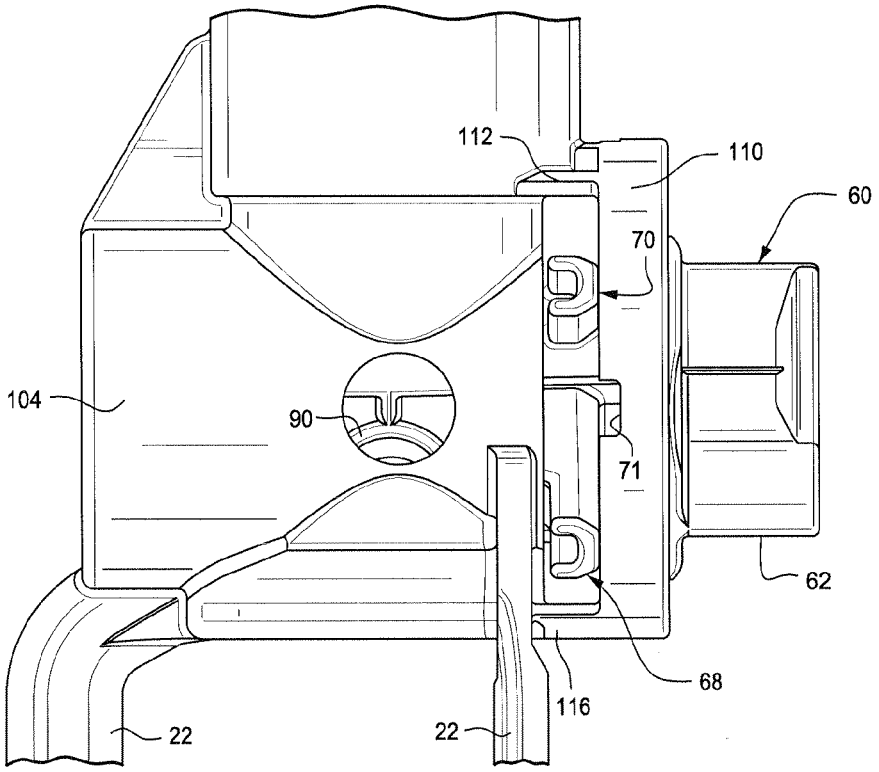
FIG. 13 is an enlarged partial left side elevation of the sprinkler body and nozzle insert as shown in FIG. 12.
Figure 14:
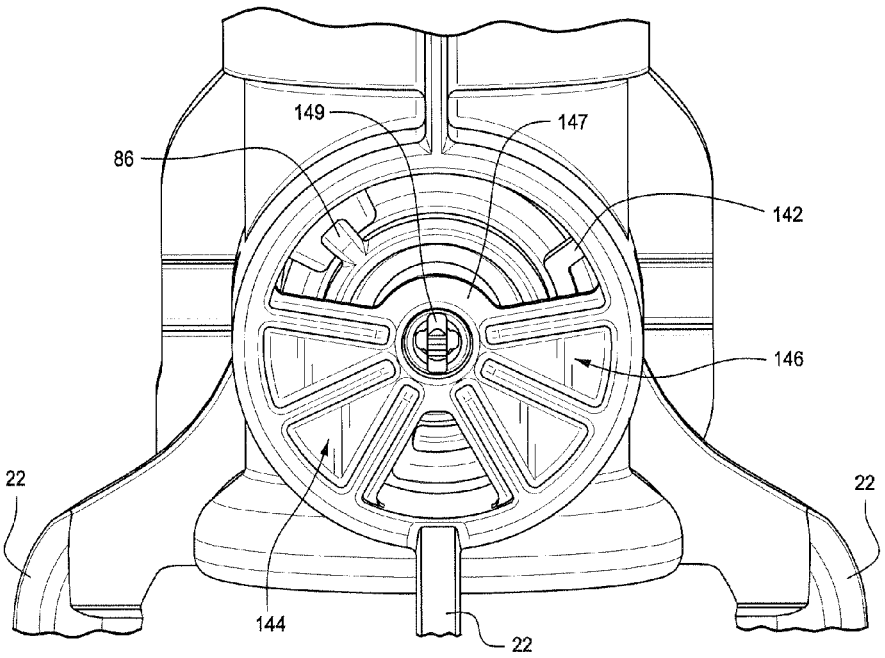
FIG. 14 is an enlarged, partial rear view of the sprinkler body and nozzle insert as shown in FIG. 12.

FIGS. 12-14 illustrate the nozzle insert 14 rotated an additional 45 degrees in a clockwise direction beyond the "ON" position to a position intermediate the "ON" position and the "OFF" position. Note that because the index tab 68 is radially longer than the remaining insertion slots 124, 126 and 128, the nozzle insert 14 will be retained within the sprinkler body recess 16 as it rotates between its various operating positions, reacting against the force applied by spring 148. Thus, the radially-longer tab 68 slides across the radially-shorter slots 124, 126, 128 as the nozzle insert rotates beyond the INSERTION position.

In addition, as the nozzle insert 14 rotates between its operating positions, the rotation movement itself is facilitated by the keeper tab 86 engaged with the cam tabs 136, 138 and 140 (FIG. 14) located circumferentially between the various operating positions (as defined by the index notches 69, 71, 73 and 75 on the back side of the collar 110). In other words, the spring pressure is relieved as the nozzle insert 14 rotates between its operating positions (and hence between the index notches) because the camming action of the keeper tab 86 moves or cams the insert 14 slightly inwardly in opposition to the spring force, and thus away from the back side of the collar 110. As already noted above, rotation is also facilitated by the beveled edges of the index tabs 68, 70, 72 and 74 which engage the edges of the respective notches 69, 71, 73 and 75. These features ensure a smooth and easy rotation of the nozzle insert 14 from one position to the next. It will be appreciated that this same interaction occurs at each of the four operating positions.

Figure 15:
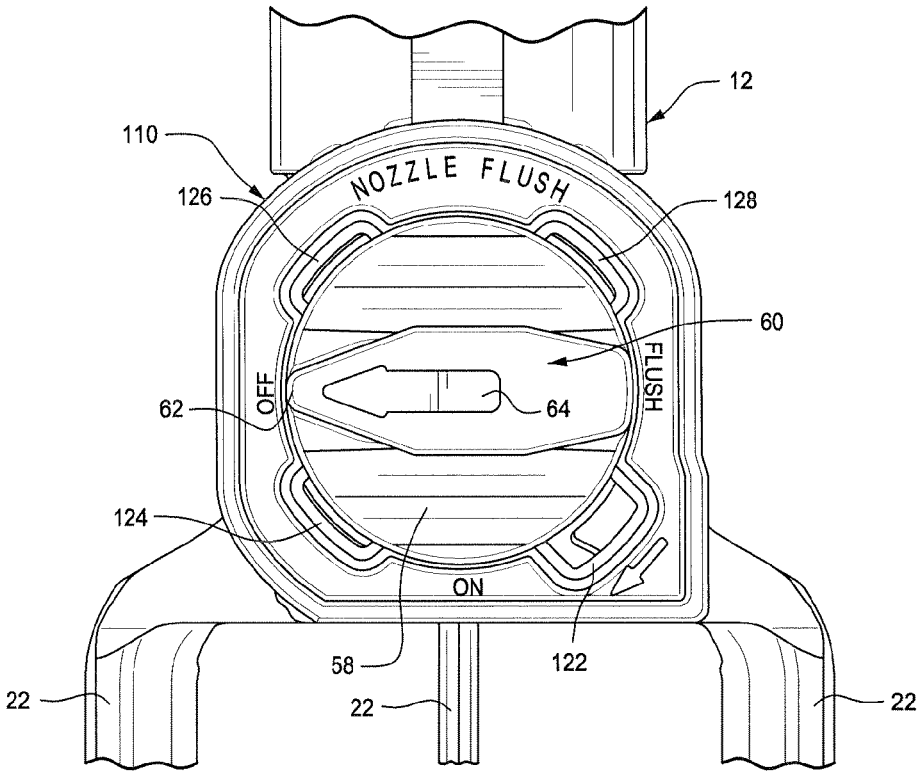
FIG. 15 is an enlarged, partial front view of the sprinkler body and nozzle insert with the insert rotated 45 degrees in a clockwise direction from the intermediate position shown in FIG. 12 to the "OFF" position.
Figure 16:
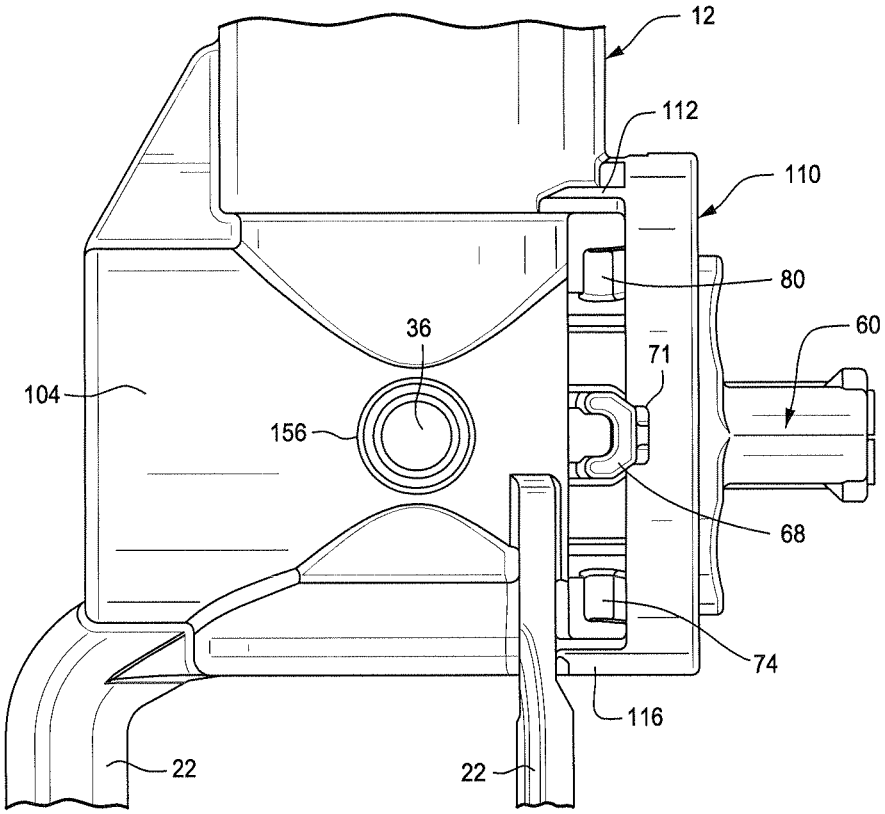
FIG. 16 is an enlarged, partial left side elevation of the sprinkler body and nozzle insert as shown in FIG. 15.
Figure 17:
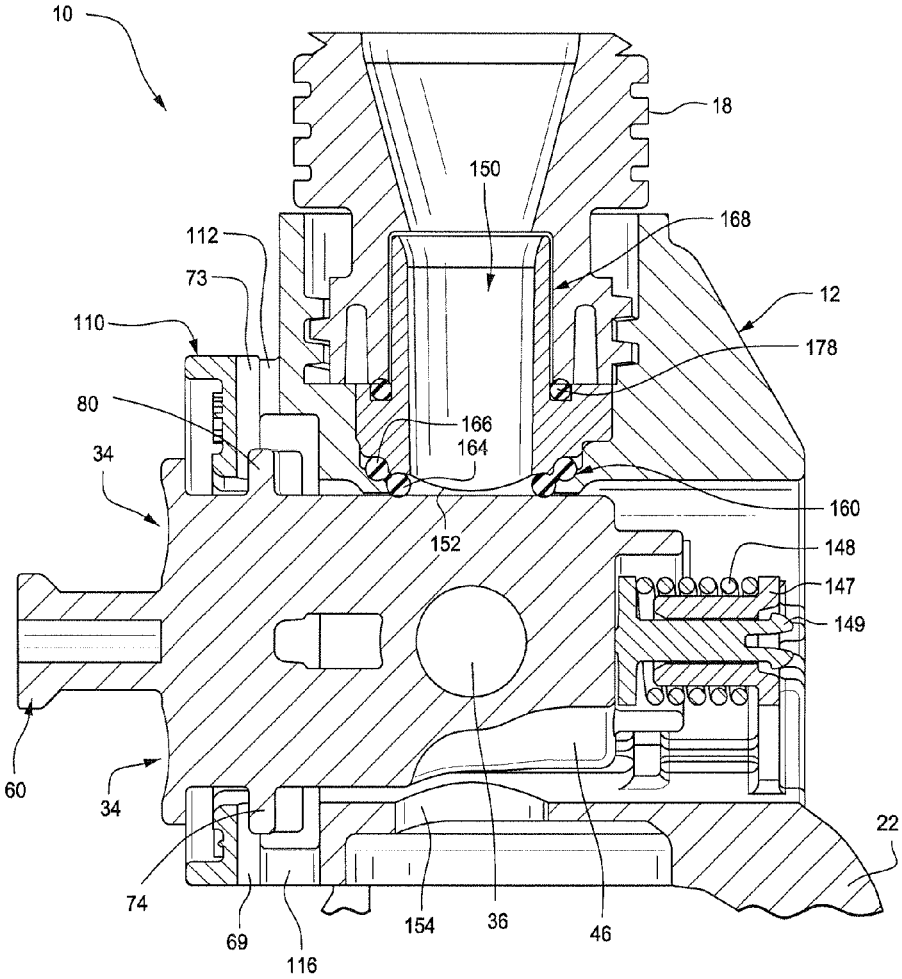
FIG. 17 is a vertical cross section of the sprinkler body and nozzle insert as shown in FIG. 15.

FIGS. 15-17 illustrate the nozzle insert rotated an additional 45 degrees in the clockwise direction to the "OFF" position. In this position, and as best seen in FIG. 17, the solid peripheral surface 48 on the nozzle insert body 34 is engaged by the seal 160 and thus shuts off flow from the sprinkler body flow passage 150 at the aperture 152. In this position, the index tabs 68, 70, 72 and 74 are biased into engagement with respective index notches 71, 73, 75 and 69.

In the OFF position, the nozzle bore 36 is aligned with sprinkler body apertures 156, 158 as best seen in FIGS. 16 and 17. Accordingly, while the sprinkler is OFF, the nozzle bore 36 can be cleaned manually of any debris that is tightly wedged in the bore and unable to be removed in the NOZZLE FLUSH position described below.

Figure 18:
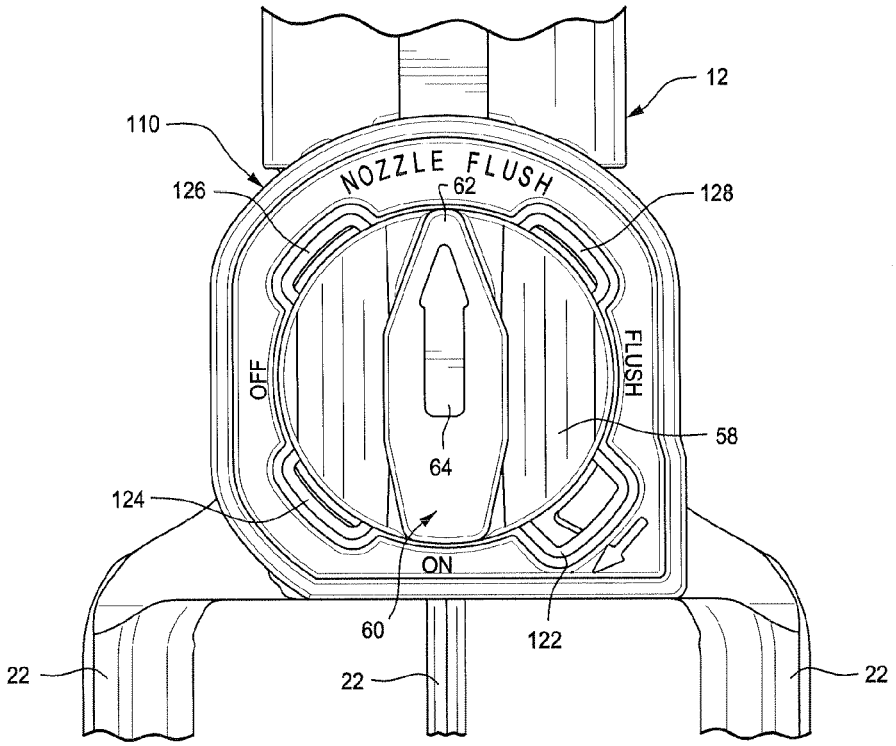
FIG. 18 is an enlarged, partial front view of the sprinkler body and nozzle insert with the nozzle insert rotated 90 degrees in a clockwise direction from the "OFF" position to the "NOZZLE FLUSH" position.
Figure 19:
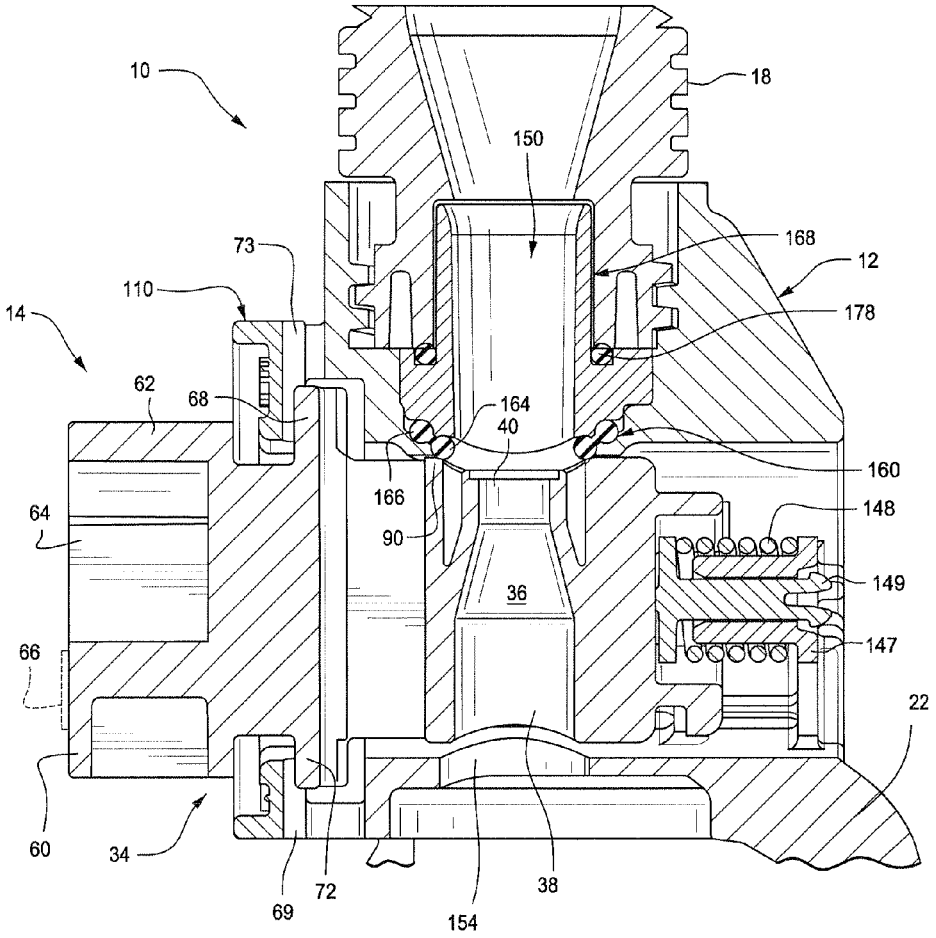
FIG. 19 is a vertical cross section of the sprinkler body and nozzle insert as shown in FIG. 18.
Figure 19A:
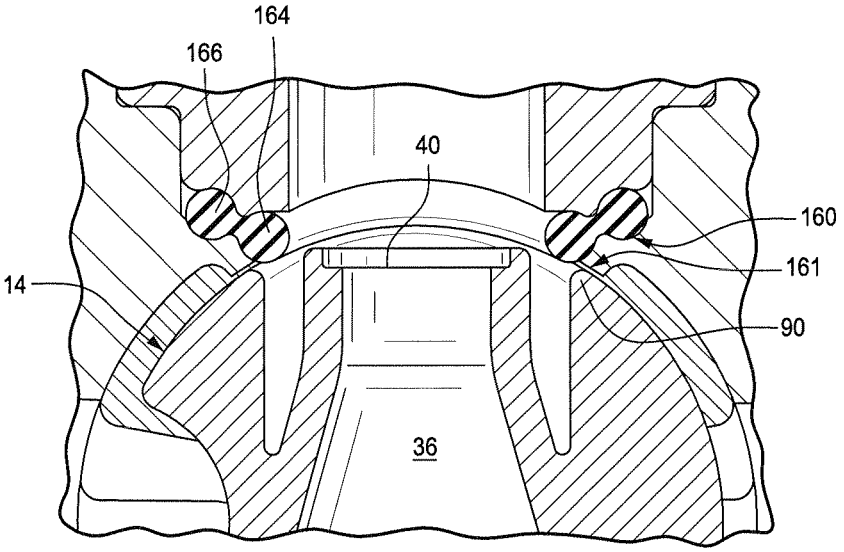
FIG. 19A is a view similar to FIG. 19 but rotated to show another circumferential portion of the sprinkler body seal relative to the nozzle insert in the NOZZLE FLUSH position.

FIGS. 18-19A illustrate the nozzle insert 14 rotated another 90 degrees in the clockwise direction to the "NOZZLE FLUSH" position, with the index tabs 68, 70, 72 and 74 engaged, respectively in index notches 73, 75, 69 and 71 (partially shown in FIG. 19). FIG. 19 also illustrates how the nozzle bore 36 is now fully reversed (or inverted) relative to its orientation in the nozzle "ON" position, so that the water stream enters the nozzle bore 36 through the smaller-diameter orifice 40 and expands through the remaining length of the bore, flushing debris out through the larger-diameter inlet end 38. In the NOZZLE FLUSH position, the seal 160 engages only a portion of the surface of the nozzle bore wall 90 surrounding the smaller-diameter orifice 40. More specifically, there is a significant gap 161 between the seal 160 and the nozzle bore wall 90, varying about the periphery of the seal/bore wall interface (compare FIGS. 19 and 19A). Leakage from the nozzle orifice 40 across the bore wall 90 through the gap 161 provides a visual indicator to the user, even from long distances, that the nozzle is not in the ON position. This is important because with some nozzle sizes, the user may inadvertently leave the nozzle in the NOZZLE FLUSH position thereby producing a misdirected flow and an incorrect flow rate which, if not quickly identified, can lead to crop damage.

Figure 20:
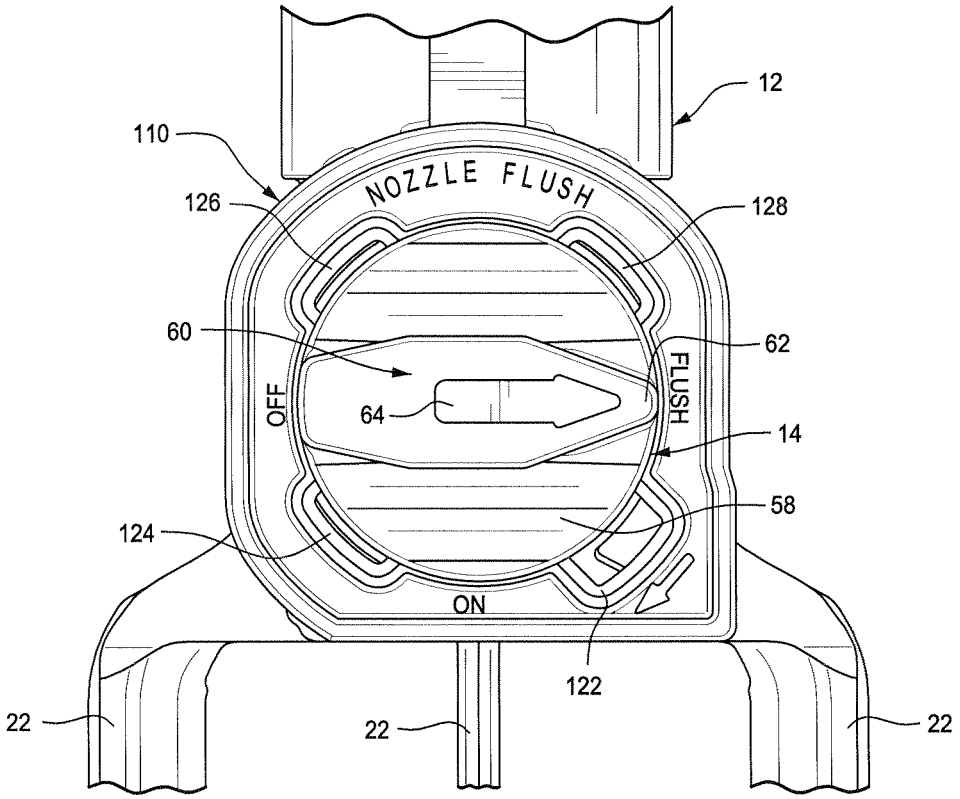
FIG. 20 is an enlarged, partial front view of the sprinkler body and nozzle insert, with the nozzle insert rotated 90 degrees in a clockwise direction from the "NOZZLE FLUSH" position to the "FLUSH" position.
Figure 21:
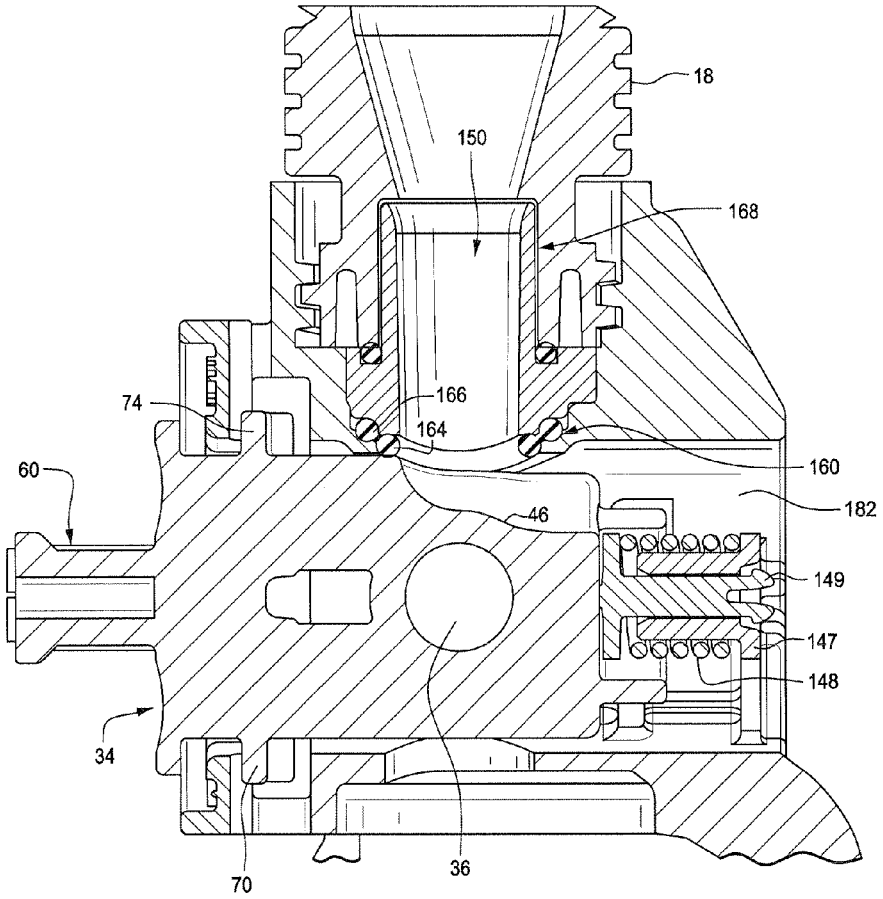
FIG. 21 is a vertical cross section of the sprinkler body and nozzle insert as shown in FIG. 20.

FIGS. 20 and 21 illustrate the nozzle insert 14 rotated an additional 90 degrees to the LINE FLUSH position, (indicated on the collar 110 simply as "FLUSH"). Here, water from the sprinkler body flow passage 150, exiting aperture 152, is directed into the flush groove 46 and the water exits the relatively large opening 182 between the web portions 144 and 146 at the rearward end of the sprinkler body 12. (FIGS. 14, 21). In the LINE FLUSH position, the index tabs 68, 70, 72 and are biased into engagement with respective index notches 75, 69, 71 and 73.

Figure 22:
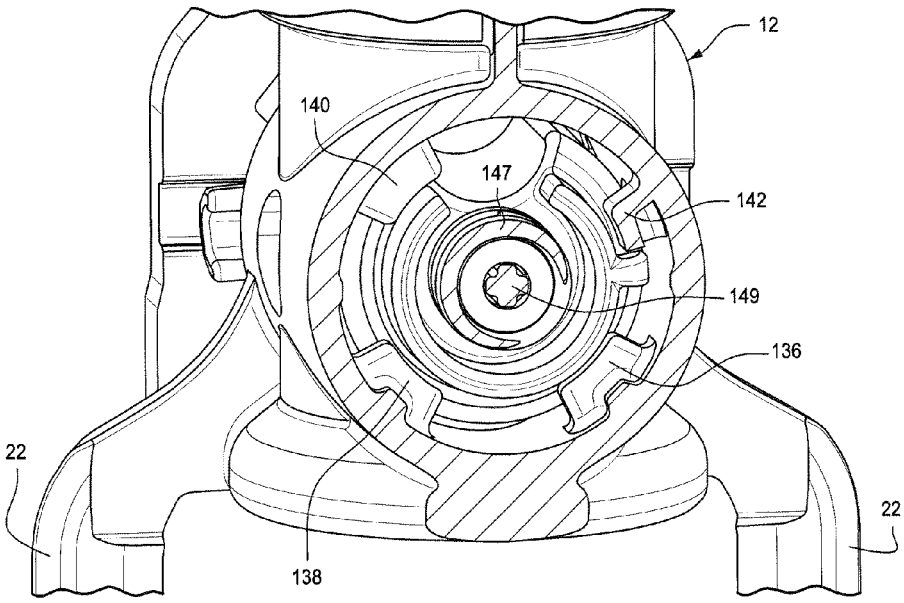
FIG. 22 is a partial rear perspective view of the sprinkler body and nozzle insert as shown in FIG. 20.

FIG. 22 illustrates the keeper tab 86 in engagement with the opposite side of the cam/stop tab 142, which prevents further rotation of the nozzle insert in the clockwise direction past the LINE FLUSH position. Thus, in order to move from the LINE FLUSH position to another operating position or to remove the nozzle insert 14, it must be rotated back in a counterclockwise direction as necessary to reach the desired position.

Note also that in the LINE FLUSH position, the nozzle bore 36 is again aligned with apertures 156 and 158 in the sprinkler body, thus providing an additional opportunity to manually clean the nozzle bore.

An important feature of the illustrated embodiment is the manner in which the variously-described structural features combine to accurately align the nozzle insert 14 in the ON position. More specifically, the centerline of the nozzle bore 36 must be positioned within ±0.005" of the sprinkler body flow passage centerline in the left-to-right and fore-to-aft directions, and must be positioned rotationally about axis A within ±0.5°. The combination of water pressure and seal compression forces the nozzle insert 14 (and hence the insert body 34) against ribs 130 and thereby accomplishes the left-to-right centering. The tab/detent/spring arrangement accomplishes the fore-to-aft and the rotational centering. There is also a very fine balance that has to be maintained with respect to stability and ease of use. For example, the nozzle insert needs to be securely positioned such that when jostled by crops such as corn stalks, it won't be inadvertently moved out of the desired operating position. At the same time, however, the nozzle insert must be relatively easy to insert and rotate by hand (perhaps hundreds of times in a day when doing initial assembly of pivot packages or changing out systems in the field). In addition, it is important for the user/operator to know with certainty that the nozzle is properly positioned. This is accomplished by enabling the user to feel or hear the index tabs snap or click into the index notches by reason of the axial force exerted by the spring 148. When changing operating positions, the user can push and turn (easier option) or just turn (more torque required) the nozzle insert 14 until rotation begins. Then, if the user continues turning without pushing, the nozzle insert body 34 will click into the next set of index notches. This rotation and spring action will accurately locate the nozzle insert so long as the nozzle insert is sufficiently free to move axially and rotationally and thereby enable the spring 148 to drive the index tabs fully home (i.e., where the beveled index tab surfaces are in full contact with the beveled index notch surfaces).

To insure the required freedom of movement of the nozzle insert, generous clearances are maintained between the nozzle insert and the sprinkler body wherever possible. Further in this regard, the nozzle insert itself is formed to permit water to leak past the seal 160 during position changes to flush out impacted sand, etc.

While the invention has been described in connection with what is presently considered to be the most practical and preferred embodiment, it is to be understood that the invention is not to be limited to the disclosed embodiment, but on the contrary, is intended to cover various modifications and equivalent arrangements.

What is claimed:

1. A sprinkler and side-loading nozzle insert assembly comprising:

a sprinkler body provided with a flow passage and a nozzle insert seated in a complementary recess in said sprinkler body, said nozzle insert rotatable to plural operating positions; said nozzle insert comprising an elongated insert body having an insert axis about which said nozzle insert rotates, a nozzle bore extending through said insert body on an axis intersecting said insert axis and alignable with said flow passage in one of said plural operating positions, a forward end face provided with a turning knob, plural index tabs extending radially from said insert body at circumferentially-spaced locations proximate said forward end face, adapted to engage respective index notches in said sprinkler body as said insert body is rotated to said plural operating portions, wherein said flow passage lies on a longitudinal center axis of said sprinkler body perpendicular to said insert axis, wherein said complementary recess is defined by a substantially cylindrical wall and a collar axially-spaced forwardly of a front end of said substantially cylindrical wall, said collar formed with insert slots arranged to receive said plural index tabs during insertion of said nozzle insert into said complementary recess in an insertion direction, wherein said plural index notches are located on a back face of said collar between said insert slots, wherein a spring is provided within said sprinkler body to bias said nozzle insert in a direction opposite said insertion direction and to bias said plural index tabs into respective ones of said plural index notches as said nozzle insert is rotated into said plural operation positions, wherein said sprinkler body is provided with plural cam tabs and a stop tab proximate a rearward end of said complementary recess, said plural cam tabs and said stop tab extending radially inwardly, and wherein said plural cam tabs are axially aligned with respective ones of said insert slots.

2. The sprinkler and side-loading nozzle insert assembly of claim 1 wherein said plural operating positions include at least a nozzle ON position where an inlet end of said nozzle bore is aligned with and adjacent said flow passage; a nozzle OFF position where said flow passage is sealed by a surface of said nozzle insert; and a nozzle FLUSH position where said nozzle bore is inverted and aligned with said flow passage.

3. The sprinkler and side-loading nozzle insert assembly of claim 2 wherein said plural operating positions include a LINE FLUSH position where said flush groove is aligned with said flow passage.

4. The sprinkler and side-loading nozzle insert assembly of claim 1 wherein said insert body is provided with a rearward end face, a part-annular ring extending axially away from said rearward end face, and a keeper tab located at a rearward end of said part-annular ring, extending in a radially outward direction, leaving a gap between said tab and said rearward end face.

5. The sprinkler and side-loading nozzle insert assembly of claim 4 wherein said keeper tab engages said stop tab upon insertion of said nozzle body into said complementary recess thereby preventing rotation of said nozzle insert in one of two opposition directions.

6. The sprinkler and side-loading nozzle insert assembly of claim 5 wherein, during rotation of said nozzle insert between said operating positions, said keeper tab engages said cam tabs to thereby cam said nozzle insert rearwardly and relieve said bias of said spring.

7. The sprinkler and side-loading nozzle insert assembly of claim 2 wherein, in both the ON and OFF positions, a flexible seal supported on said sprinkler body surrounding the flow passage, seals against said insert body.

8. The sprinkler and side-loading nozzle insert assembly of claim 7 wherein said flexible seal is comprised of radially inner and outer ring portions, said outer ring portion clamped between a radial flange of a sleeve located within said flow passage, and said inner ring portion engaging said insert body.

9. The sprinkler and side-loading nozzle insert assembly of claim 3 wherein, in both the OFF and LINE FLUSH positions, said nozzle bore is aligned with apertures on diametrically-opposed sides of said sprinkler body, thereby enabling manual cleaning of said nozzle bore.

10. The sprinkler and side-loading nozzle insert assembly of claim 1 wherein said nozzle insert is formed with at least one opening permitting attachment of one or more of said nozzle inserts on a wire or string.

11. The nozzle insert of claim 1 wherein said flow passage defines a center axis, wherein said complementary recess extends into said sprinkler body from one side of said sprinkler body, intersecting said center axis and said flow passage, said sprinkler body including a support structure for mounting a water distribution plate aligned with and downstream of said complementary recess;

wherein said nozzle bore comprises a nozzle outlet orifice, a shut-off surface for shutting off flow through said flow passage, and a flush groove formed on a surface circumferentially spaced apart from said nozzle bore, wherein said nozzle insert is indexable via rotation to at least:

a first operating position where said nozzle bore and said nozzle orifice are coaxially aligned with said flow passage; a second operating position where said shut-off surface seals against said flow passage to prevent flow through said nozzle bore; a third operating position where said nozzle bore is reversed such that said nozzle outlet orifice is aligned with and adjacent said flow passage to thereby permit flushing of said nozzle bore; and a fourth position where said flush groove is aligned with said flow passage such that a stream exiting said flow passage is directed into said flush groove to thereby flush the flow passage upstream of the nozzle insert.

* * * * *